United States Patent [19]

Collins, Jr. et al.

[11] Patent Number: 4,902,221

[45] Date of Patent: Feb. 20, 1990

[54] BURNER ASSEMBLY FOR COAL FIRED FURNACES

[75] Inventors: Raymond L. Collins, Jr., Hudson; Stephen A. Bryk, Mogadore, both of Ohio

[73] Assignee: Control Systems Company, Stow, Ohio

[21] Appl. No.: 48,794

[22] Filed: May 12, 1987

[51] Int. Cl.[4] ..... F23M 9/00; F23D 1/00

[52] U.S. Cl. ..... 431/183; 431/2; 431/9; 431/182; 110/263

[58] Field of Search ..... 431/183, 182; 110/263, 110/264, 265; 239/403, 399

[56] References Cited

U.S. PATENT DOCUMENTS

| | | | |
|---|---|---|---|
| 2,046,767 | 7/1936 | Campbell | 110/22 |
| 2,233,529 | 3/1941 | Herr | 158/76 |
| 2,803,296 | 8/1957 | Young | 158/76 |
| 3,775,039 | 11/1973 | Pillard | 431/350 |
| 4,057,021 | 11/1977 | Schoppe | 110/28 A |
| 4,147,116 | 4/1979 | Graybill | 110/263 |
| 4,270,895 | 6/1981 | Vatsky | 431/183 |
| 4,274,343 | 6/1981 | Kokkinos | 110/263 |
| 4,321,034 | 3/1982 | Taccone | 110/263 X |
| 4,428,727 | 1/1984 | Deussner et al. | 110/263 X |
| 4,448,135 | 5/1984 | Dougan et al. | 110/263 |
| 4,457,241 | 7/1984 | Itse et al. | 110/347 |
| 4,471,703 | 9/1984 | Vatsky et al. | 110/263 |
| 4,497,263 | 2/1985 | Vatsky et al. | 110/347 |
| 4,559,009 | 12/1985 | Marino et al. | 431/184 |
| 4,611,543 | 9/1986 | Collette | 110/263 |
| 4,627,366 | 12/1986 | LaRue et al. | 110/263 |
| 4,654,001 | 3/1987 | LaRue | 431/354 |

FOREIGN PATENT DOCUMENTS

| | | |
|---|---|---|
| 0062228 | 3/1982 | Fed. Rep. of Germany . |
| 311261 | 5/1929 | United Kingdom . |
| 2057114 | 8/1979 | United Kingdom . |
| 2098721 | 2/1981 | United Kingdom . |
| 2119081 | 4/1982 | United Kingdom . |

*Primary Examiner*—Larry Jones

*Attorney, Agent, or Firm*—Renner, Kenner, Greive, Bobak, Taylor & Weber

[57] ABSTRACT

A burner assembly (10) for the combustion of pulverized coal in furnaces (12) and the like. The assembly comprises wind box means (23) for providing a primary source of air to the interior (13) of the furnace; feeding means (30) for delivering pulverized coal through a wall (11) of the furnace and into the interior thereof; means for supplying (31) a secondary flow of air through the feeding means and into the furnace separate from the primary flow of air; and swirler means (32) having a plurality of blades around the feeding means so that the first flow moves around and through the blades for imparting a rotation to the primary flow of air to penetrate the pulverized coal funnel. A method for supplying pulverized coal to furnaces and the like through burner assemblies is also provided and results in increased combustion efficiency.

8 Claims, 4 Drawing Sheets

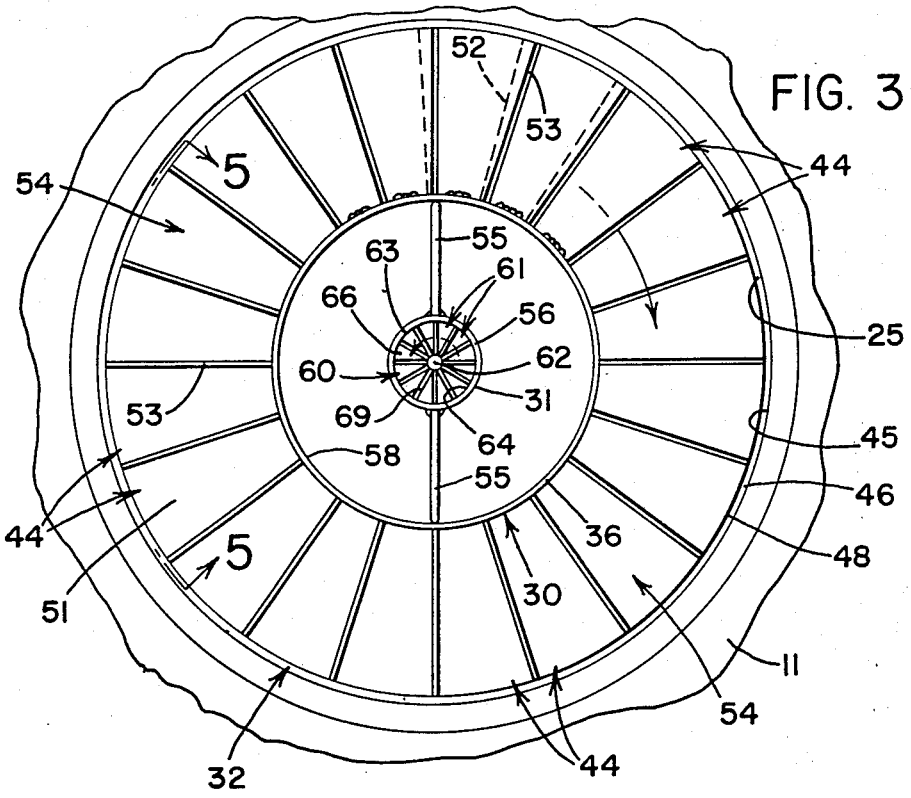
FIG. 3
FIG. 4
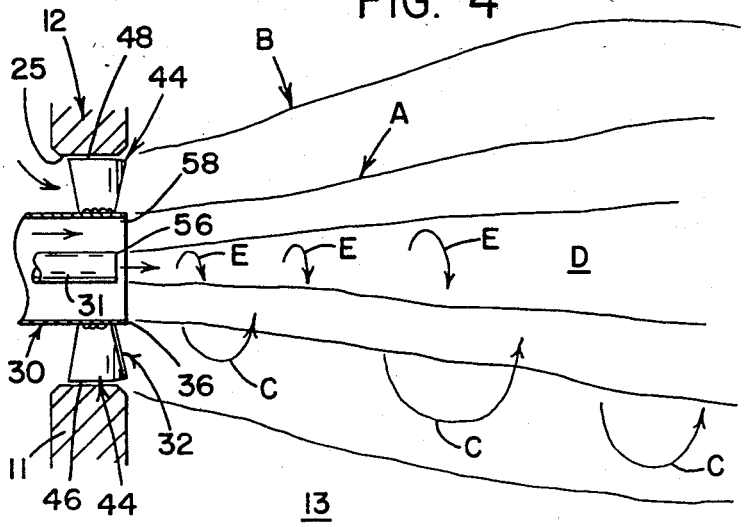

BURNER ASSEMBLY FOR COAL FIRED FURNACES

TECHNICAL FIELD

The present invention is directed toward burner assemblies for large steam generating units, viz., boilers. Each assembly provides a feed of pulverized coal and a supply of air to a furnace where it is burned. Such boilers are typically found on land for power generation or heat production while much smaller boilers may be used in certain specialized applications.

BACKGROUND ART

Typically, the furnace walls are lined with water tubes, pipes through which water is circulated, heated and converted into steam and collected in a large drum usually above the furnace. In order to heat large quantities of water, multiple burner assemblies can be employed which are inserted through at least one wall of the furnace or at each of the corners or roof mounted, depending upon the designs of the manufacturer. The burners are at least positioned so that combustion occurs at or near the center of the furnace interior so that the heat is more evenly spread.

The coal fuel is pulverized before it is fed into the furnace through a coal nozzle. There, combustion is started with a smaller gas or oil flame which provides the necessary combustion temperature and input to ignite the coal. In addition to the air used to carry the pulverized coal, other air is supplied through an air or wind box and is circulated within a larger conduit through which the burner assembly is positioned. This air enters the furnace circumferentially around the pulverized coal to provide a source of air for proper combustion. Additionally, more air can be fed into the furnace from other sources.

The air is intended to insure complete as well as controlled combustion of the coal. Controlled combustion means that the flame should begin at or near the mouth of the coal nozzle and extend to the center of the furnace interior in a large, bushy shape. When the combustion is not properly controlled, the flame may not begin until some distance from the tip and then it may burn with a narrow shape appearing more as a jet or torch. When this occurs, some quantity of the coal is not combusted and it will either fall to the furnace floor or be carried through the furnace and become deposited on various heat transfer surfaces. The latter creates the potential for catastrophic air heater fires and the like. As to the combusted quantity, it may provide a flame beyond the center of the furnace which provides uneven heating and in extreme occasions it could focus on several of the tubes on the far wall which can lead to premature failure. In addition, it is known that a narrow, pencil-like flame cannot provide the same amount of energy as a large bushy flame.

Current operating practice of existing coal burners involves supplying the total amounts of fuel and air to the furnace. Individual control of fuel and air to groups of burners is made through macroscopic adjustments to the pulverizer capacity, main forced draft fan flows and the like. In an attempt to mix coal and air properly, movable register doors of various design and configurations have been employed. These register doors are generally located away from the point of coal entry into the furnace and essentially function as an on/off gate for the flow of air to any given burner and are not a control device. Existing burner assemblies have used various combinations of air supplies, conduits and swirling devices in an attempt to create a structured turbulence that encompasses the pulverized coal and passes between the particles to provide sufficient air at each coal particle in the expectation that complete and maximum combustion will occur. Nevertheless, complete and efficient combustion can only be achieved by supplying the correct amounts of air and fuel which must undergo proper mixing at specific locations within the coal burner/furnace interface.

Despite the years that burner assemblies have been employed and the many design variations, flame adjustment or control can take much time or coal fuel is wasted and in some instances, maximum combustion efficiency is never obtained. More complex assemblies may increase some segments of combustion efficiency but these are more labor intensive and require longer down time of the furnace when work is required on the various components which must be periodically removed, disassembled and cleaned or replaced.

DISCLOSURE OF THE INVENTION

It is therefore an object of the present invention to provide a burner assembly for furnaces and the like wherein coal fuel is combusted to generate heat and steam.

It is another object of the present invention to provide a burner assembly that provides more complete combustion of the coal fuel.

It is another object of the present invention to provide a burner assembly that provides a controlled, improved flame pattern.

It is yet another object of the present invention to provide a burner assembly that is more efficient and is less costly to service and maintain.

It is still another object of the present invention to provide a method whereby combustion efficiency of pulverized coal fuel is improved.

It is a further object of the present invention to provide a method for combustion whereby flame pattern is controlled and improved.

These and other objects, together with the advantages thereof over known burner assemblies, which shall become apparent from the specification which follows, are accomplished by the invention as hereinafter described and claimed.

In general, a burner assembly for the combustion of pulverized coal in furnaces and the like comprises means for providing a primary source of air to the furnace interior; feeding means for delivering pulverized coal through a wall of the furnace and into the interior thereof; means for supplying a secondary flow of air through said feeding means and into the furnace separate from the primary flow of air and, swirler means having a plurality of blades interposed around the feeding means so that the primary flow of air moves around and through the blades for imparting a rotation thereto penetrating the pulverized coal.

The present invention also provides a method for supplying pulverized coal and air to furnaces and the like through a burner assembly resulting in increased combustion efficiency. Such a method comprises the steps of providing a primary flow of air into the interior of the furnace; delivering a pulverized coal funnel through a wall of the furnace and into the interior thereof with fuel feeding means; supplying a secondary flow of air through the feeding means and into the furnace interior separate from the primary flow of air; interrupting the primary flow of air so that a portion of the flow moves axially forward into the furnace interior while another portion is imparted a rotation and, encompassing the pulverized coal funnel with the primary flow of air as the coal funnel enters the furnace while simultaneously expanding the coal funnel with the secondary flow of air whereby both flows break up the coal funnel within the furnace.

BRIEF DESCRIPTION OF THE DRAWINGS

FIG. 3 is a frontal elevation depicting the air swirler from the burner assembly of FIG. 2 as viewed from inside of the furnace;

FIG. 4 is a diagrammatic view of the air and of the fuel mixture emanating from the burner assembly of the present invention.

PREFERRED EMBODIMENT FOR CARRYING OUT THE INVENTION

Figure 1:
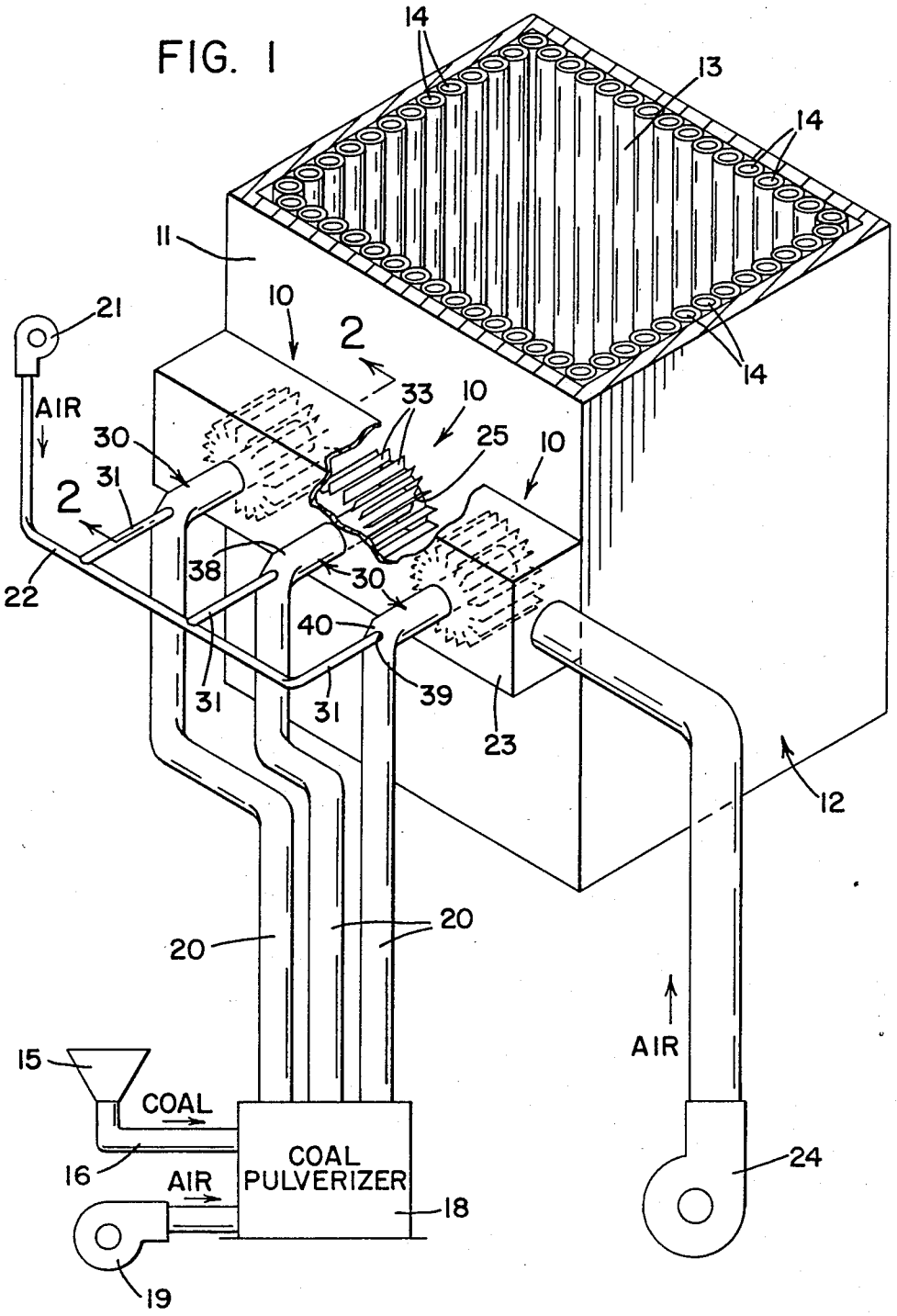
FIG. 1 is an overall perspective view of a furnace for steam generation depicting a configuration of three burner assemblies with coal fuel and air supplies.

With reference to FIG. 1, a trio of burner assemblies, generally referred to by the numeral 10 is depicted mounted on and through a wall 11 of a furnace 12. The furnace interior 13 is lined along its walls with a plurality of tubes 14 through which water is circulated, heated and converted to steam.

It will be appreciated that FIG. 1 is only illustrative of furnaces in general having water/steam tubes and that for clarity and discussion the top of the furnace has not been shown, nor has any steam drum or means for circulating steam and returning water been presented. The present invention is not directed toward furnaces and the generation of steam, per se, only improved burner assemblies that can be employed therewith. Thus, it is to be understood that practice of the present invention is not limited to the use of three burner assemblies or any other plurality; nor is the use of one precluded. Moreover, the assemblies can be mounted in a side wall, as depicted, or at the corners of the furnace, as is known.

Coal is supplied from a hopper 15 and is conveyed through chute 16 to a coal pulverizer 18. The pulverizer is conventional and provides internally a suitable grinding mechanism for reducing the coal to the required particle size. Fan air is fed into the pulverizer through a fan 19 and forces the coal particles out through coal pipes 20. A screen or classifier is normally employed in the pulverizer to permit only the desired size of coal particle to exit. Air is also fed to the coal fuel from a blower 21 and pipes 22. An air or wind box 23, is also provided which serves as a manifold to supply large quantities of air via fan 24 to the furnace interior for combustion of the pulverized coal. Each of the burner assemblies is suitably affixed to a port or throat 25 in the furnace wall 11 such as by bolts and flanges (not shown) which permit disassembly and re-installation or replacement of the assembly.

Figure 2:
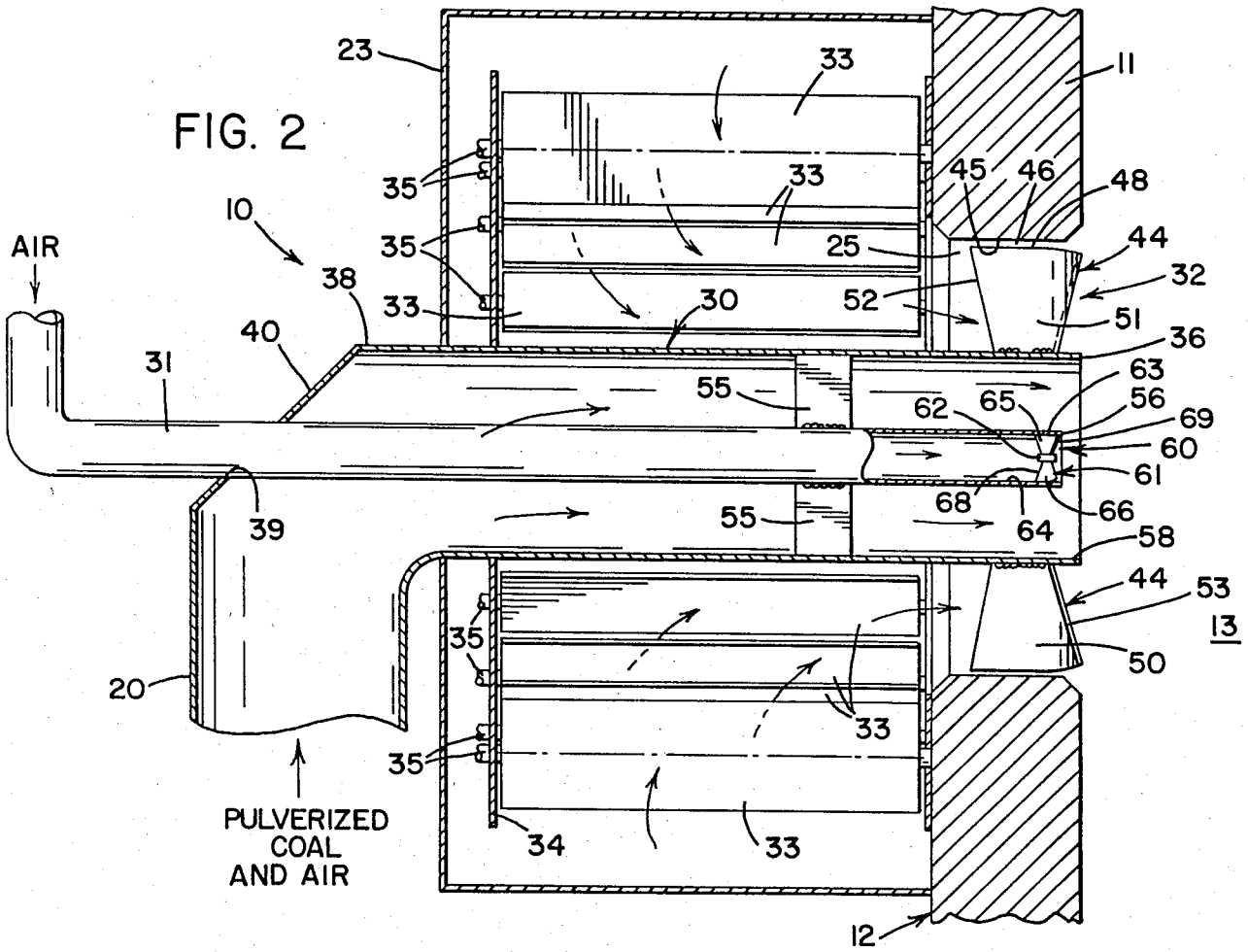
FIG. 2 is an enlarged side elevation, partially in section, and taken substantially along line 2—2 of FIG. 1, depicting one burner assembly according to the present invention.

With reference to FIG. 2, the burner assembly 10 is depicted. It comprises the wind box 23 or other source of primary air supply; coal tube feeding means 30; means for supplying a secondary air supply, conduit 31 and an air swirler 32. The wind box 23 is a large duct-like structure, as depicted in FIG. 1, which provides a large volume of air under pressure that is blown into the furnace interior 11 through the ports 25. It is the primary source of air for combustion of the pulverized coal since the furnace is otherwise sealed to contain the heat of combustion.

As is customary, register doors 33 are provided within the wind box to close off the flow of air through a port 25 if a particular burner assembly 10 is not being used. These doors 33 are pivotally mounted to a generally circular frame 34 via rods 35. A linkage mechanism (not shown) can be operated to rotate the doors between closed and opened positions. Although a primary source of air is required and can be provided as just described, it is to be understood that the burner assembly of the present invention does not require register doors 33 to be operative. If a burner assembly is ignited, they will be open to permit combustion to occur, otherwise they can be closed.

The coal tube or feeding means 30 is a metal tube having a diameter of between eight and 24 inches (20 to 60 cm). It passes through the furnace port 25 and is open at end 36 to the furnace interior. At the opposite end 38, feeding means 30 is connected to the tube 20 from pulverizer 18. An opening 39 in the rear wall 40 of the feeding means 30 is provided through which the conduit 31 passes.

It can be seen in FIG. 2 that the primary volume of air is fed from the wind box 23 and through the port 25 directly into the furnace interior. Rather than deliver a forward moving blast of air, the swirler 32 is provided in the opening through the furnace wall 11. The swirler comprises a plurality of blades 44 which are affixed to the end 36 of feeding means 30. The blades 44 extend radially outwardly toward the inner wall 45 of port 25.

A narrow axial space 46 is provided between the outermost edge 48 of each blade 44 and inner wall 45. This space is important for it allows some of the air moving through port 25 to flow around the swirler 32 and continue in an axial flow. The diameter of existing swirlers has been considerably less than the inner diameter of port 25 and an outer annular ring encompasses the blade edges 48. Thus, significant amounts of the axially moving air passing through port 25 flow around the swirler. By increasing the diameter of the swirler 32 to substantially that of the port 25, greater control over the flame pattern has resulted as well as improved combustion efficiency. Elimination of the outer ring and provision of the space 46 allows some of the air to flow around the swirler which also contributes to greater control and efficiency.

Figure 5:
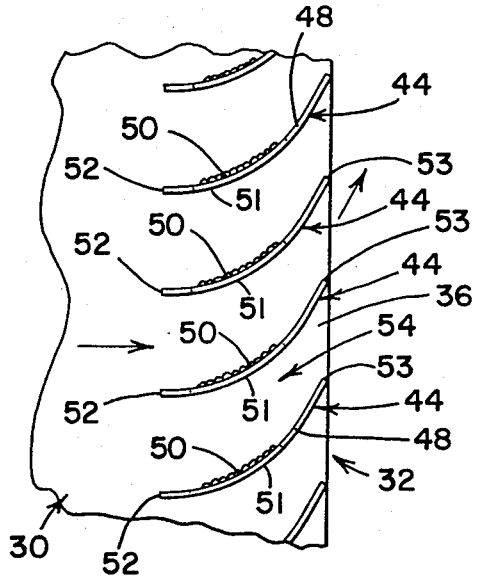
FIG. 5 is a developed view, taken substantially along line 5—5 of FIG. 3, depicting the blades of the air swirler.

With reference to FIGS. 3 and 5, the swirler 32 is depicted in greater detail. Each blade 44 is curved to present a concave rear face 50 and a convex front face 51 which is directed toward the furnace interior. Each blade also presents a leading edge 52 which is confined within the port 25 and a trailing edge 53 toward the furnace interior. The blades are each affixed to the tube end 36 in an overlapping configuration so that the leading edge 52 of one blade overlaps the trailing edge 53 of the next blade.

In this manner, air passing through the housing port 25 cannot pass straight through any of the blades but first contacts the rear faces 50. As the air moves around the leading edge 52 of a blade, its path is next impeded by the trailing edge 53 of an adjacent blade. Because the blades are each curved, the air is given a curved slotted passageway 54 through which to flow which imparts a rotational movement to the air as it enters the furnace.

The conduit 31 is centered and supported within the coal tube by one or more spiders 55. The mouth 56 of conduit 31 terminates slightly within the mouth 58 of coal tube 30. Its purpose is to provide a secondary supply of air directly at the center of the pulverized coal stream forced into the furnace. However, rather than deliver a forward moving volume of air, a swirler element 60 can be employed within the mouth 56.

Swirler 60 provides a plurality of blades 61 which are welded to a shaft 62. The blade outermost edges 63 extend directly to the inner wall 64 of conduit 31 several of which may be tack welded in place. Each blade 61 provides a concave rear face 65, a convex front face 66 toward the furnace interior as well as leading and trailing edges 68 and 69, respectively. Although the swirler 60 has smaller dimensions than swirler 32, it is otherwise similar to the latter. The swirlers are preferably constructed so that the flow of primary air is rotated in one direction, e.g., clockwise, while the flow of secondary air is rotated in the opposite direction, e.g., counterclockwise. Of course, due to the smaller dimensions, no axial space is provided between swirler 60 and inner wall 64 of conduit 31.

At this point, reference is drawn to FIG. 4 which depicts, diagrammatically the various flow patterns. First, the pulverized coal and air mixture is seen exiting the mouth 58 of coal tube 30 where it fans outwardly to form an expanding cone or funnel A. The large volume of primary air B passing through the port 25 contacts the swirler 32 and encompasses the pulverized coal fuel funnel A, in a separate cone B. The air in cone B rotates in the direction of the arrows C and helps to disperse the coal fuel funnel A with air. Simultaneously, a central volume of secondary air is delivered through the conduit 31 at D, where it also passes directly into the funnel A. The swirler 60, not shown in FIG. 4, causes the secondary air to rotate in the direction of the arrows E, helping to open the fuel funnel A as the primary air, cone B slices into it. All of this results first in a heavy concentration of air directly at the coal tube mouth. Second, rather than move forwardly, which would confine funnel A, the air components B and D penetrate the coal fuel cone, dispersing the coal particles with air to maximize combustion efficiency.

Thus, it should be clear that the present invention succeeds in providing an improved burner assembly employing structure that delivers usable air in the immediate vicinity of the stream of pulverized coal particles. Use of the foregoing burner assembly facilitates the method of the present invention which supplies air to pulverized coal to provide increased combustion efficiency. As noted hereinabove, such a method is practiced by delivering a pulverized coal funnel A through a wall of the furnace 12 and into the interior thereof with fuel feeding means 30, supplying a secondary flow of air D through the feeding means and into the furnace interior separate from the primary flow of air, interrupting the primary flow of air so that portions thereof move axially forward into the furnace interior while another portion is imparted a rotation and, encompassing the pulverized coal funnel with the primary flow of air as the coal funnel enters the furnace while simultaneously expanding the coal funnel with the secondary flow of air whereby both flows of air break up the coal funnel within the furnace.

Thus, it should be clear to those skilled in the art the manner in which the burner assembly described herein is constructed, assembled and used. Based upon the foregoing disclosure, it should also be apparent that the use of the assembly described herein will carry out the objects set forth hereinabove. It will also be apparent to those skilled in the art that the burner assembly of the subject invention can readily be utilized in conjunction with various types of furnaces.

It is to be understood that any variations evident fall within the scope of the claimed invention; therefore, the selection of specific component elements can be determined without departing from the spirit of the invention herein disclosed and described. Moreover, the scope of the invention shall include all modifications and variations that may fall within the scope of the attached claims.

We claim:

1. A burner assembly for the combustion of pulverized coal in furnaces and the like comprising:

feeding means for delivering a pulverized coal funnel through a port in the wall of said furnace and directly into the interior thereof, said feeding means having a mouth extending through said port;

means for providing a first flow of air to the interior of said furnace separate from said feeding means and said pulverized coal funnel prior to passage into said interior;

means for supplying a separate, second flow of air through said feeding means and into said furnace separate from said first flow of air and said pulverized coal funnel prior to entrance into said furnace interior; and swirler means having a plurality of overlapping blades extending radially outwardly from said feeding means foreclosing direct axial passage of the majority of said first separate flow of air therethrough, and terminating a short distance from said port to provide a narrow axial space for the passage of a minor portion of said first separate flow of air.

2. A burner assembly, as set forth in claim 1, wherein the furnace provides a port for said burner assembly and said means for providing a first flow of air comprises a wind box opening through said port.

3. A burner assembly, as set forth in claim 2, wherein said feeding means passes through said wind box and provides a mouth extending through said port.

4. A burner assembly, as set forth in claim 3, wherein said swirler means is carried by the mouth of said feeding means.

5. A burner assembly, as set forth in claim 3, wherein said means for supplying said second flow of air passes through said feeding means.

6. A burner assembly, as set forth in claim 5, further comprising second swirler means having a plurality of blades interposed within said means for supplying said second flow of air so that said second flow of air moves through said plurality of blades for imparting a rotation of said second flow of air to expand said coal funnel.

7. A method for supplying pulverized coal and air to furnaces and the like through a burner assembly resulting in increased combustion efficiency comprising the steps of:

delivering a pulverized coal funnel through a port in the wall of said furnace and directly into the interior thereof with fuel feeding means;

providing a first flow of air into the interior of said furnace separate from said pulverized coal funnel and said fuel feeding means;

supplying a second flow of air through said feeding means and into said furnace interior separate from said first flow of air and said pulverized coal funnel prior to entrance into said furnace interior;

interrupting said first flow of air to provide a major portion and a minor portion;

directing said major portion through a plurality of curved slotted passageways formed by a plurality of overlapping blades which foreclose direct axial passage between adjacent blades along their entire length;

allowing said major portion of air to expand radially as it passes through said curved slotted passageways;

directing said minor portion around the circumferential edge of said blades to combine with said radially expanding air as said major and minor portions move forward into said furnace interior; and encompassing said pulverized coal funnel with said first flow of air as said coal funnel enters said furnace while simultaneously expanding said coal funnel with said second flow of air whereby both said flows break up said coal funnel within said furnace.

8. A method, as set forth in claim 7, including the additional step of interrupting said second flow of air by directing it through a plurality of curved slotted passageways formed by a plurality of overlapping blades which foreclose direct axial passage between adjacent blades along their entire length, thereby imparting rotation thereto.

* * * * *